US009425535B2

(12) United States Patent
Kim et al.

(10) Patent No.: US 9,425,535 B2
(45) Date of Patent: Aug. 23, 2016

(54) CONNECTOR COVER FOR PART IN ECO-FRIENDLY VEHICLE AND METHOD OF FASTENING THE SAME

(71) Applicant: Hyundai Motor Company, Seoul (KR)

(72) Inventors: Jee-Heon Kim, Guri-si (KR); Ju-Man Yoon, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 67 days.

(21) Appl. No.: 14/444,526

(22) Filed: Jul. 28, 2014

(65) Prior Publication Data

US 2015/0180155 A1 Jun. 25, 2015

(30) Foreign Application Priority Data

Dec. 24, 2013 (KR) ..... 10-2013-0162021

(51) Int. Cl.

| | |
|---|---|
| ***H01R 13/453*** | (2006.01) |
| ***H01R 43/00*** | (2006.01) |
| ***H01R 13/447*** | (2006.01) |
| ***H01R 13/52*** | (2006.01) |

(52) U.S. Cl.

CPC ..... *H01R 13/447* (2013.01); *H01R 13/453* (2013.01); *H01R 13/5213* (2013.01); *Y10T 29/49963* (2015.01)

(58) Field of Classification Search

CPC .. H01R 13/453; H01R 13/447; H01R 43/00; H01R 13/5213; H01R 13/639; H01R 13/62; H01R 13/6271; H01R 13/6273; Y10T 29/49963; B60L 11/1818

USPC ..... 174/67, 50, 50.51, 50.52, 520, 174/559–563; 439/135–150; 29/525.11; 320/109

See application file for complete search history.

(56) References Cited

U.S. PATENT DOCUMENTS

| | | | | |
|---|---|---|---|---|
| 4,087,624 | A * | 5/1978 | Hitchcock | A62C 3/16 169/48 |
| 4,684,190 | A | 8/1987 | Clark et al. | |
| 5,107,075 | A * | 4/1992 | Currier, Jr. | H01R 13/447 174/67 |
| 7,354,310 | B1 * | 4/2008 | Brown | H01R 13/424 439/596 |
| 7,750,789 | B2 * | 7/2010 | Titokis | H01R 13/62944 337/194 |

FOREIGN PATENT DOCUMENTS

| | | | |
|---|---|---|---|
| JP | 06-191360 | A | 7/1994 |
| JP | 2006-127905 | A | 5/2006 |
| JP | 2012-195163 | A | 10/2012 |
| KR | 20-0261791 | Y1 | 1/2002 |
| KR | 10-2010-0081409 | A | 7/2010 |

* cited by examiner

*Primary Examiner* — Dimary Lopez Cruz

(74) *Attorney, Agent, or Firm* — McDermott, Will & Emery LLP

(57) ABSTRACT

A connector cover in an eco-friendly vehicle covers the outside of a connector for an electronic part mounted to the eco-friendly vehicle. The cover covers the outside of the connector, and a width thereof is adjusted. The cover grasps both sides of the connector, is coupled to the outside of the connector as the width of the cover becomes narrower, and maintains a state in which the width is narrowed.

10 Claims, 6 Drawing Sheets

CONNECTOR COVER FOR PART IN ECO-FRIENDLY VEHICLE AND METHOD OF FASTENING THE SAME

CROSS-REFERENCE(S) TO RELATED APPLICATIONS

This application claims the benefit of priority to Korean Patent Application No. 10-2013-0162021, filed on Dec. 24, 2013, which is incorporated herein by reference in its entirety.

TECHNICAL FIELD

The present disclosure relates to a connector cover in an eco-friendly vehicle, which is coupled to an outside of a connector for an electronic part in the eco-friendly vehicle, and a method of fastening the same. The disclosure relates, more particularly, to a connector cover in an eco-friendly vehicle, which covers a connector for an electronic part mounted in the eco-friendly vehicle, the connector being exposed to the outside regardless of the size of the part, preventing accidents caused by touching the connector, and a method of fastening the same.

BACKGROUND

In an eco-friendly vehicle such as an electric vehicle or a hybrid vehicle, a variety of power converters, such as, an inverter, an inductance-to-digital converter (LDC), and an on-board charger (OBC), are mounted in an engine room and connected to each other through a connector.

As shown in FIGS. 1 and 2, an engine room 1 in an eco-friendly vehicle is provided with an engine room cover 2 for protecting a power converter (not shown), a variety of electronic parts constituting the power converter, or an engine of a hybrid vehicle. The engine room cover 2 is disposed near the electronic parts or over the engine, instead of covering a particular part. Accordingly, since the cover 2 occupies broad areas and has increased weight, it is problematic in that fuel efficiency is reduced and manufacture is costly.

One side of an electronic part in the eco-friendly vehicle is provided with a connector 10, in order to connect with another electronic part. The connector 10 is provided with a plurality of locking devices 11 and 12 for safety. Since the connector 10 is exposed to the outside without a dedicated cover for the connector 10, there is a safety risk when inexperienced maintenance workers including a driver come into contact with the locking devices.

SUMMARY

An embodiment of the inventive concept is directed to a connector cover in an eco-friendly vehicle, capable of covering a connector for an electronic part in the eco-friendly vehicle so as not to be exposed to the outside and capable of fastening the connector regardless of the size thereof, and a method of fastening the same.

Other objects and advantages of the present disclosure can be understood by the following description, and become apparent with reference to embodiments of the inventive concept. Also, it is obvious to those skilled in the art to which the present disclosure pertains that the objects and advantages of the present disclosure can be realized by the means as claimed and combinations thereof.

In accordance with an aspect of the inventive concept, a connector cover for an eco-friendly vehicle covers the outside of a connector for an electronic part mounted to the eco-friendly vehicle. The cover may cover the outside of the connector, and a width thereof may be adjusted. The cover may grasp both sides of the connector, be coupled to the outside of the connector as the width of the cover becomes narrower, and maintain a state in which the width is narrowed.

The cover may include a main body fastened to one side of the connector. A pair of coupling portions may be slidably installed to the main body, pressed against the sides of the connector while being inserted into the main body, and slide in directions opposite to each other. A tightening means may maintain a state in which the coupling portions grasp the sides of the connector.

The coupling portions may be disposed on the same line as each other and slide in the directions opposite to each other.

The tightening means may include a fixing gear installed on a lower surface of the cover. A tightening wheel is rotatably installed to the cover and is formed with an internal gear engaging with the fixing gear. A wire connects the tightening wheel to the coupling portions.

Teeth of the fixing gear and the internal gear may be formed such that the tightening wheel is rotatable only in a direction in which the wire is wound around the tightening wheel.

The teeth of the fixing gear and the internal gear may form an inclined surface at a portion which abuts each other in a direction in which the wire is wound around the tightening wheel, and the teeth of the fixing gear and the internal gear may form a vertical surface at a portion which abuts each other in the other direction in which the wire is wound around the tightening wheel.

The coupling portions may be bent at portions of being coupled to the connector.

The main body may be formed with a fastening hole through which a fastening bolt for fastening the main body to the connector passes.

The back of the main body may be formed with a guide which supports both sides of each of the coupling portions to guide sliding of the coupling portion.

The back of the main body may be formed with a guide which surrounds the outside of each of the coupling portions to guide sliding of the coupling portion.

In accordance with another aspect of the inventive concept, a method of fastening a connector cover in an eco-friendly vehicle to a connector, includes a pair of coupling portions installed to a main body so as to be slidable in different directions from each other and grasps both sides of the connector in the eco-friendly vehicle. The method includes adjusting a width between the coupling portions by sliding the coupling portions such that the width is larger than a width of the connector. The cover is mounted to the outside of the connector. The sides of the connector are grasped by ends of the coupling portions, such that the coupling portions support the sides of the connector and maintain the grasped state using a tightening means installed to the cover. The main body is fastened to the connector by a fastening bolt which passes through the main body and is fastened to the connector.

DESCRIPTION OF SPECIFIC EMBODIMENTS

Figure 1:
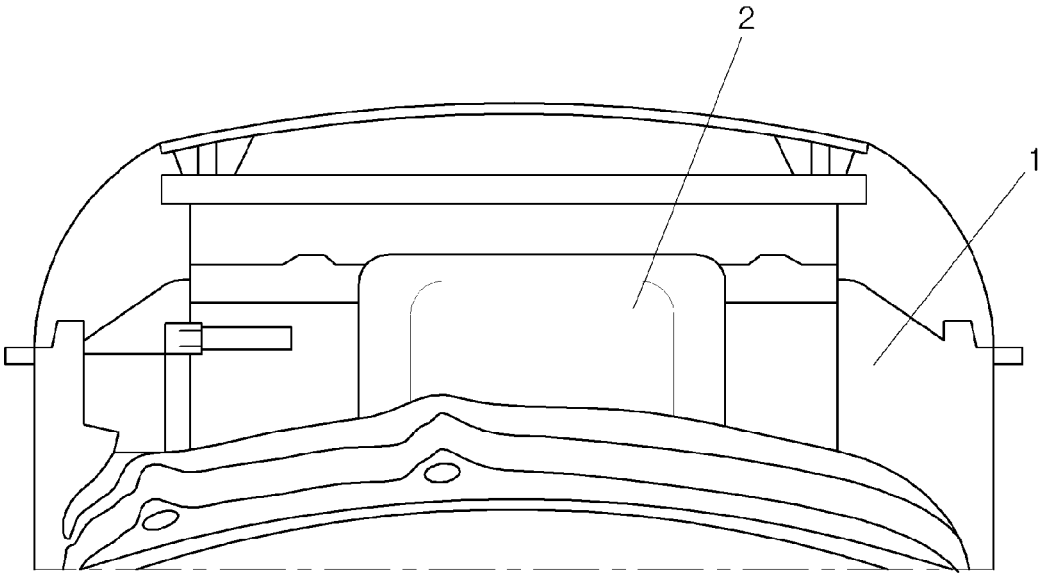
FIG.1(Prior Art)
FIG. 1 is a top view illustrating an installation state of a cover to an engine room in an eco-friendly vehicle.
Figure 2:
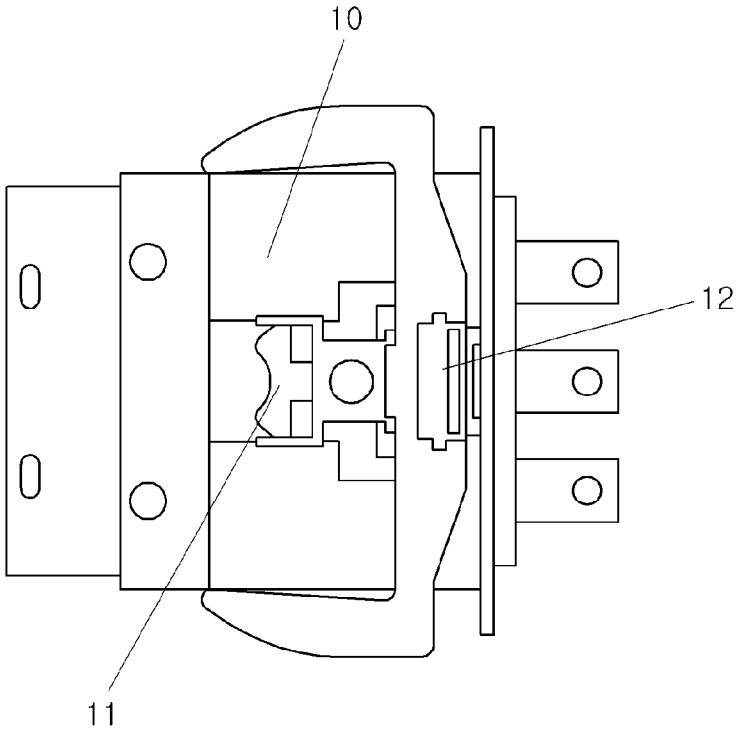
FIG.2(Prior Art)
FIG. 2 is a top view illustrating a connector for an electronic part in an eco-friendly vehicle.

A connector cover for a part in an eco-friendly vehicle according to exemplary embodiments of the inventive concept will be described below in more detail with reference to the accompanying drawings. The present disclosure may, however, be embodied in different forms and should not be construed as limited to the embodiments set forth herein. Rather, these embodiments of the inventive concept are provided so that this disclosure will be thorough and complete, and will fully convey the scope of the present disclosure to those skilled in the art. Throughout the disclosure, like reference numerals refer to like parts throughout the various figures and embodiments of the inventive concept.

Figure 3:
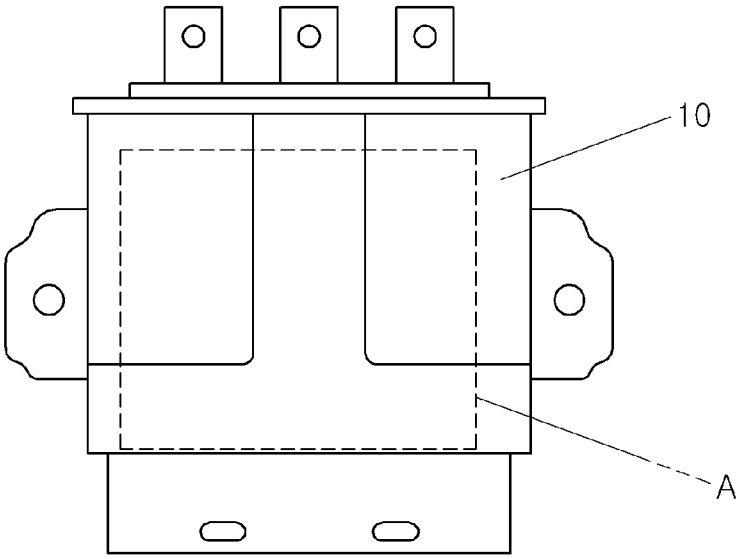
FIG. 3 is a bottom view illustrating a connector for an electronic part in an eco-friendly vehicle.
Figure 4:
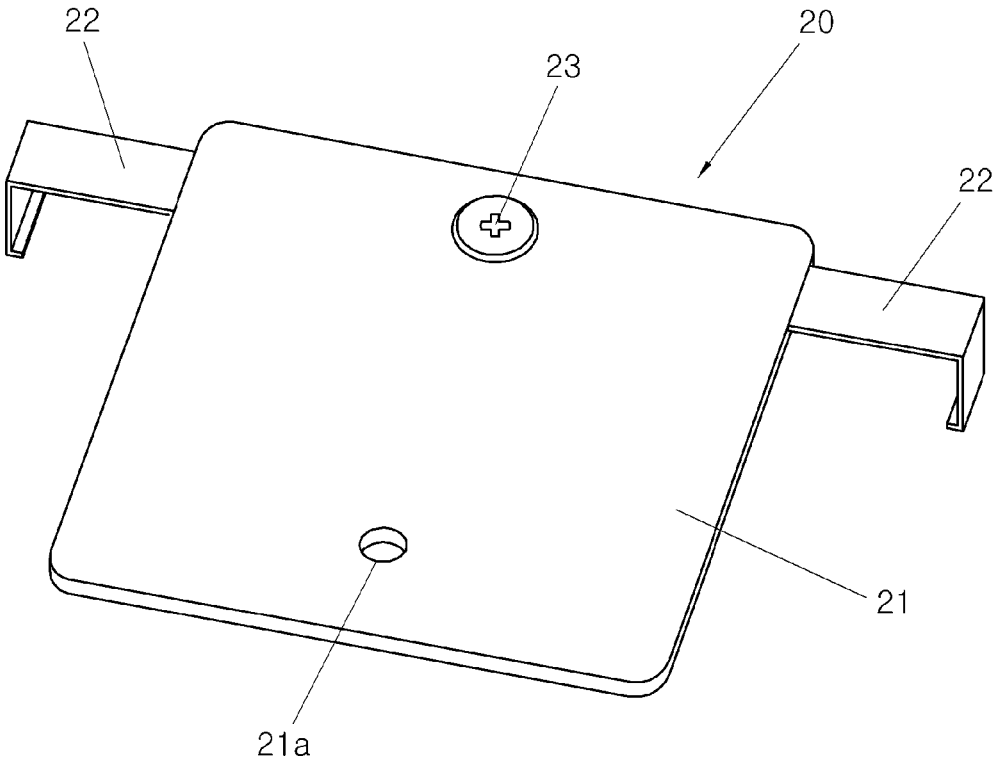
FIG. 4 is a perspective view illustrating a connector cover for a part in an eco-friendly vehicle according to the present disclosure.

Referring to FIG. 4, A connector cover 20 in an eco-friendly vehicle according to the present disclosure covers the outside of a connector 10 for an electronic part mounted to in the eco-friendly vehicle and is coupled to the connector 10 while being adjusted in width and grasping both sides of the connector 10. For example, the connector cover 20 covers a portion indicated by "A" in the connector 10 shown in FIG. 3. The connector cover 20 for the eco-friendly vehicle according to the present disclosure is installed to be adjusted in width and is in the form of grasping both sides of the connector 10. The connector cover 20 is coupled to the outside of the connector 10 as the width of the connector cover 20 becomes narrow.

A main body 21 has a plate shape, surrounds the outside of the connector 10 in the eco-friendly vehicle, and is installed with other components. The main body 21 has an area corresponding to the connector 10 in the eco-friendly vehicle. One side of the main body 21 has a fastening hole 21*a* through which a fastening bolt passes so that the main body 21 is fastened to the connector 10 using the fastening bolt.

A pair of coupling portions 22 are provided and slidably installed to the main body 21, so that the coupling portions 22 are adjusted to be suitable for the size of the connector 10. Therefore, the connector cover 20 may be installed to the connectors 10 having various sizes while being adjusted in width. In particular, the pair of coupling portions 22 are disposed on the same line as each other, thereby allowing each side of the connector 10 to be coupled on the same line.

Figure 5:
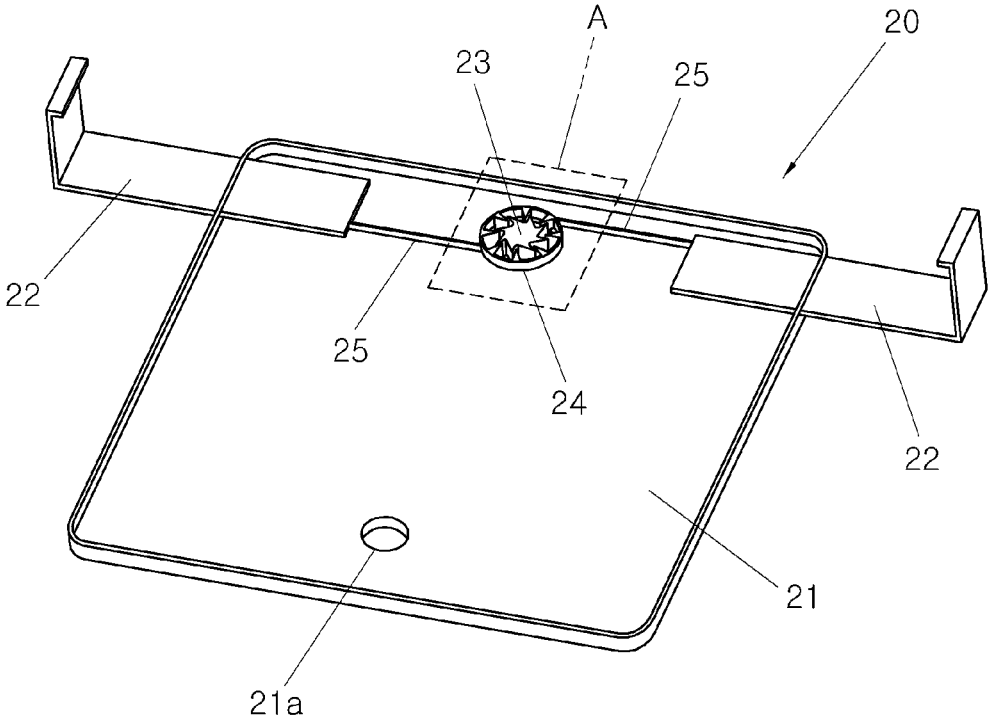
FIG. 5 is a back perspective view illustrating the connector cover for a part in an eco-friendly vehicle according to the present disclosure.

Referring to FIG. 5, each of the coupling portions 22 is bent at one end thereof for supporting one side of the connector 10 so as to grasp a side of the connector 10 while being connected, at another end thereof, with a wire 25.

The coupling portions 22 are paired and symmetrically arranged. The coupling portions 22 are tightened toward each other by a tightening means so as to be inserted into the main body 21 and are coupled to the connector 10, thereby allowing the main body 21 to be coupled to the connector 10.

The tightening means tightens the pair of coupling portions 22, which are installed to be slidable in opposite directions, toward each other. The connector cover 20 is pressed against the outside of the connector 10, and thus, a distance between the coupling portions 22 becomes narrower as the coupling portions 22 are moved toward each other.

Figure 6:
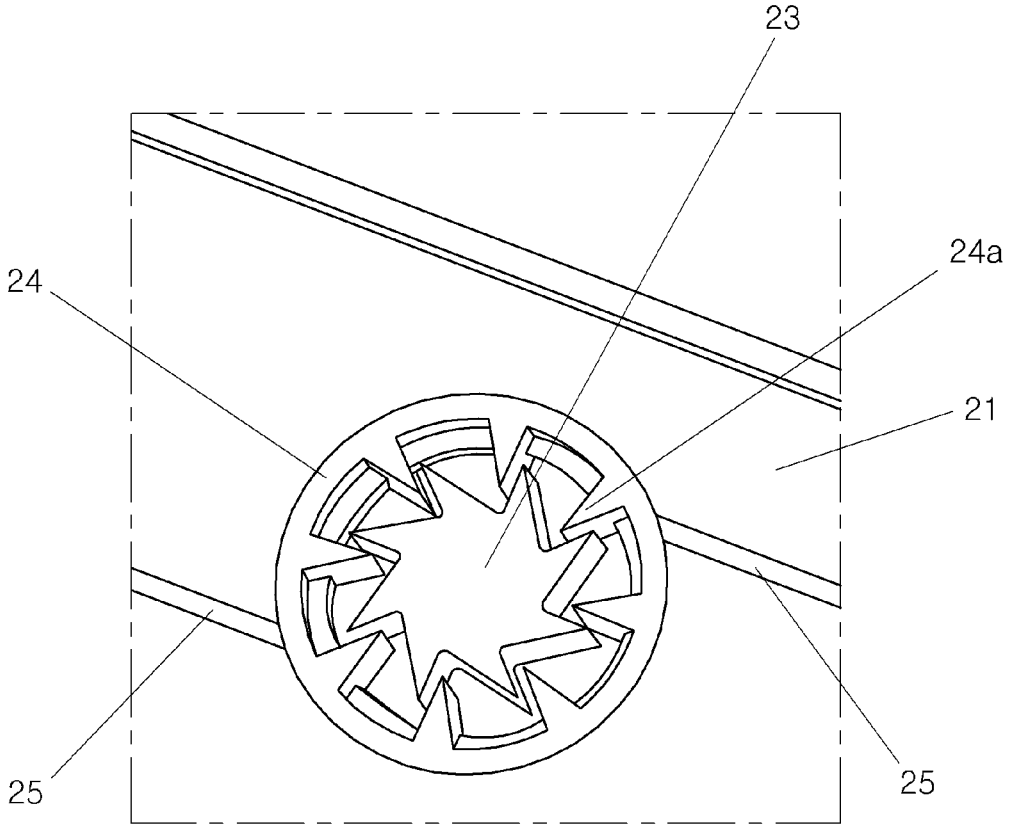
FIG. 6 is a partially enlarged view taken along portion "A" in FIG. 5.

As examples of the tightening means, there may be a fixing gear 23, a tightening wheel 24, and the wire 25 as shown in FIG. 6.

The fixing gear 23 is formed integrally with the main body 21 on the back of the main body 21. The fixing gear 23 has teeth along a circumference thereof.

The tightening wheel 24 is rotatably installed to the main body 24. The tightening wheel 24 is installed to pass through the main body 21. Accordingly, the tightening wheel 24 may be rotated and exposed to an upper surface of the main body 21. In addition, the tightening wheel 24, which is located on a lower surface of the main body 21, is formed with an internal gear 24*a* engaging with the fixing gear 23. The internal gear 24*a* is formed with teeth along an inner peripheral surface of the tightening wheel 24 and engages with the fixing gear 23.

The wire 25 connects ends of the coupling portions 22 to the tightening wheel 24. Ends of the wire 25 are fixed to the other ends of the coupling portions 22 in a state in which the wire 25 is wound around the tightening wheel 24. Accordingly, when the wire 25 is further wound around the tightening wheel 24 by rotating the tightening wheel 24, the coupling portions 22 slide to be inserted into the main body 21.

Here, the teeth of the fixing gear 23 and the internal gear 24*a* are formed such that the tightening wheel 24 may be rotated only in one direction in which the wire 25 is further wound. That is, the teeth of the fixing gear 23 and the internal gear 24*a* are formed such that reversal rotation is impossible. Therefore, the fixing gear 23 restrains rotation of the internal gear 24*a* such that the tightening wheel 24 is rotatable in a direction (counterclockwise direction in FIG. 6) in which the wire 25 is wound, whereas the tightening wheel 24 is not rotatable in the other direction, thereby restricting the rotation of the tightening wheel 24. For example, the teeth of the fixing gear 23 and the internal gear 24*a* define an inclined surface at a portion which abuts each other in a direction in which the wire 25 is wound around the tightening wheel 24, and define a vertical surface at a portion which abuts each other in the other direction.

The main body 21 may be formed with a guide 26 or 26' to guide each of the sliding coupling portions 22.

Figure 7:
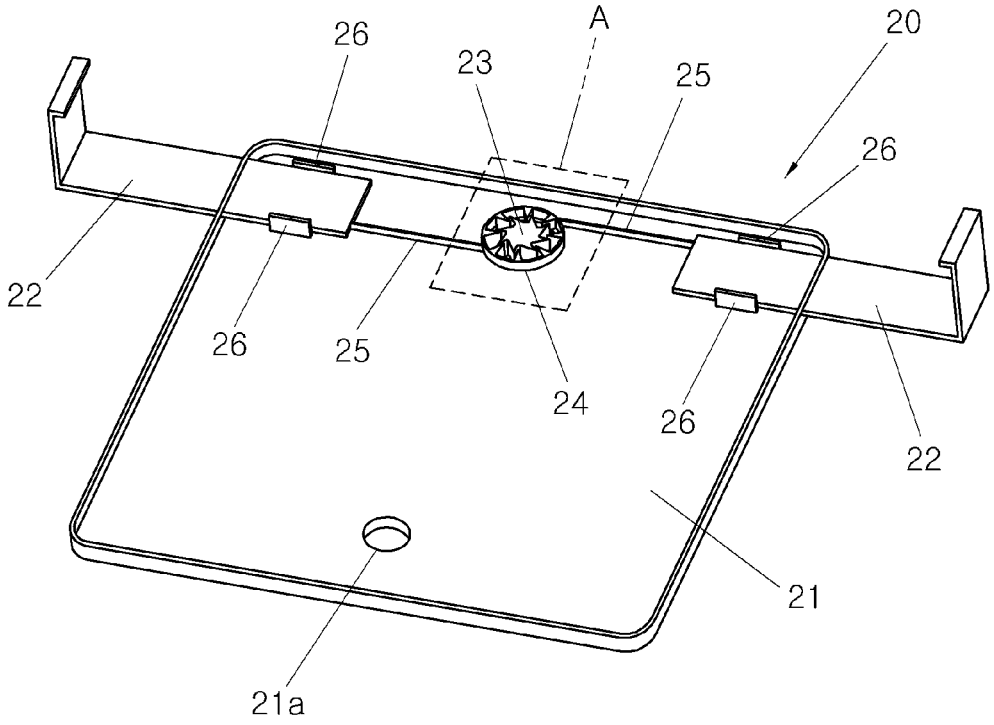
FIGS. 7 and 8 are back perspective views illustrating an example in which a guide is formed in the connector cover for a part in an eco-friendly vehicle according to the present disclosure.
Figure 8:
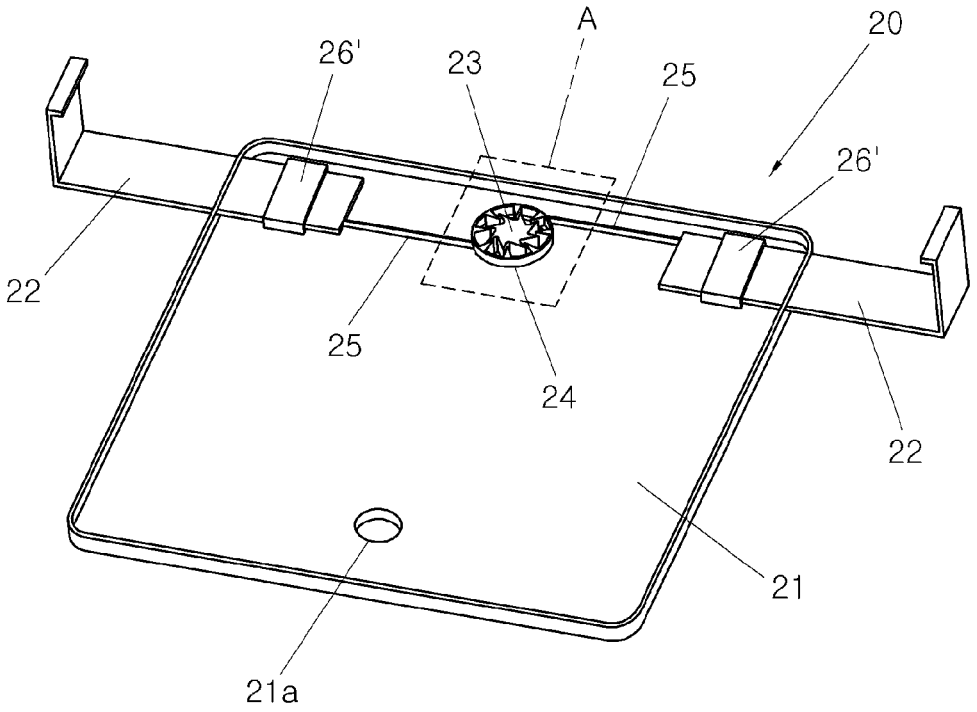
Figure 9:
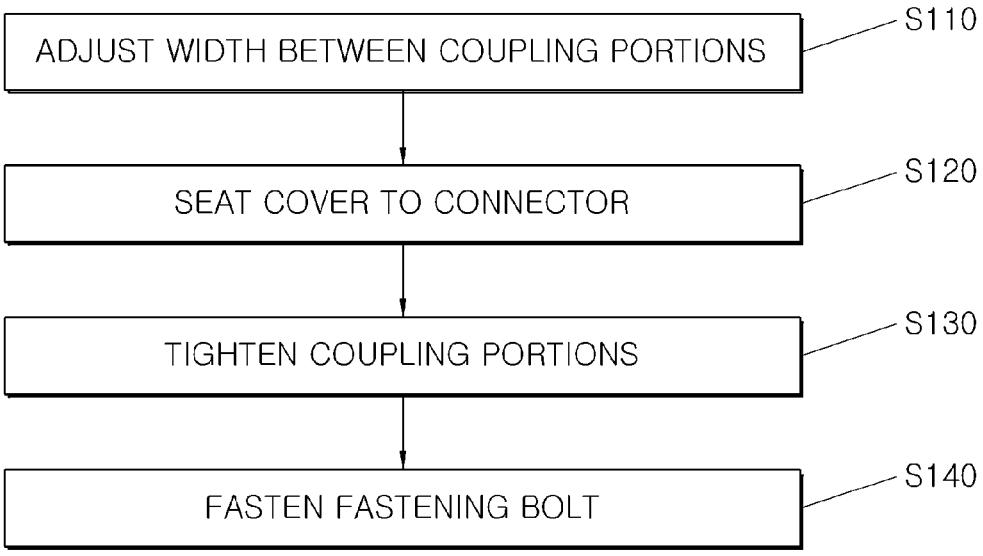
FIG. 9 is a flowchart illustrating a method of fastening the connector cover for a part in an eco-friendly vehicle according to the present disclosure.

For example, as shown in FIG. 7, the guide 26 is formed to support both sides of the coupling portions 22, or as shown in FIG. 8, the guide 26' surrounds the outside of the coupling portions 22. Consequently, the sides of the coupling portion 22 are supported when the coupling portion 22 slides relative to the main body 21, thereby enabling the coupling portion 22 to be slidably guided.

Hereinafter, an operation of the connector cover in an eco-friendly vehicle will be described according to the present disclosure having the above-mentioned configuration.

The connector 10 for an electronic part in the eco-friendly vehicle is covered by the connector cover 20 in the eco-friendly vehicle.

First, the main body 21 is mounted to the connector 10. When the main body 21 is mounted to the connector 10, the main body 21 having a plate form covers the outside of the connector 10.

When main body 21 is mounted to the connector 10, the tightening wheel 24 rotates. When the tightening wheel 24 rotates using a tool, the wire 25 is further wound around the tightening wheel 24, and the pair of coupling portions 22 pulled by the wire 25 slide in a direction of being inserted into the main body 21. The pair of coupling portions 22 are installed to each side of the main body 21. Therefore, when the pair of coupling portions 22 slide to be inserted into the main body 21, the outsides of the connector 10 are pressed against the coupling portions 22 while the coupling portions 22 are moved toward each other.

In this case, when the tightening wheel 24 rotates, the internal gear 24*a* of the tightening wheel 24 engages with the fixing gear 23, such that the tightening wheel 24 cannot reversely rotate. Accordingly, the tightening wheel 24 is rotatable only in a direction in which the wire 25 is wound. Thus, although the coupling portions 22 may be tightened to be further pressed against the outsides of the connector 10, the tightening wheel 24 is not rotatable in the other direction. Consequently, the coupling portions 22 cannot be released.

The main body 21 has the fastening hole 21*a* through which a fastening bolt passes. The main body 21 may be fastened to the connector 10 by the fastening bolt. Before or after the main body 21 is fastened to the connector 10 by tightening the coupling portions 22, the main body 21 is fastened to the connector 10 by the fastening bolt. The main body 21 is fastened to the connector 10 in such a manner, so that the main body 21 and the connector 10 may be coupled to each other without being separated from each other.

Hereinafter, a method of fastening the connector cover in an eco-friendly vehicle will be described according to the present disclosure.

The method of fastening the connector cover 20 in the eco-friendly vehicle described above to the outside of the connector 10 includes a width adjustment step S110 which adjusts a width between the coupling portions 22 by sliding the coupling portions 22 such that the width is larger than a width of the connector 10. A cover mounting step S120 mounts the cover 20 to the outside of the connector 10. A coupling portion tightening step S130 grasps sides of the connector 10 by ends of the coupling portions 22 such that the coupling portions 22 support the sides of the connector 10 and maintain the grasped state using the tightening means installed to the cover 20. A fastening bolt fastening step S140 fastens the main body 21 to the connector 10 by the fastening bolt which passes through the main body 21 and is fastened to the connector 10.

In the width adjustment step S110, the coupling portions 22 of the cover 20 are inserted into the main body 21 to a proper level by sliding, thereby moving both ends of the coupling portions 22 to a proper position.

In the cover mounting step S120, the cover 20 is temporarily mounted to a surface of the connector 10 to which the cover 20 is fastened.

In the coupling portion tightening step S130, the coupling portions 22 are coupled by grasping the sides of the connector 10 by the tightening means provided in the cover 20. That is, when the wire 25 is wound around the tightening wheel 24 by rotating the tightening wheel 24, the coupling portions 22 grasp the sides of the connector 10 while being inserted into the main body 21. In this case, since the internal gear 24*a* of the tightening wheel 24 engages with the fixing gear 23 such that reversal rotation is impossible, the coupling portions 22 maintain a state of grasping the connector 10.

In the fastening bolt fastening step S140, the main body 21 is fastened to the connector 10 by a fastening bolt which passes through the main body 21 and is fastened to the connector 10, and thus fastening the connector cover 20 in the eco-friendly vehicle to the connector 10 is completed.

As described above, since the connectors for various electronic parts in an eco-friendly vehicle are fastened and covered using the connector cover in the eco-friendly vehicle, it may be possible to prevent a variety of accidents arising from contact with the connector by unskilled workers.

In addition, by providing the cover above the engine room for protecting various power conversion devices in the conventional eco-friendly vehicle of the connector, it may be possible to improve fuel efficiency by decreasing the size of the cover and reduce the cost required to manufacture the cover.

In accordance with a connector cover in an eco-friendly vehicle and a method of fastening the same having the above-mentioned configuration according to the present disclosure, since a connector mounted in the eco-friendly vehicle is fastened to the connector cover so as to be covered from the outside thereof, it may be possible to previously prevent accidents arising from contact with the connector by unskilled workers.

In addition, the present disclosure may be applied regardless of the size of the connector for an electronic part.

Moreover, since the size of the cover used to cover a power conversion device or an engine in the eco-friendly vehicle may be reduced compared to the related art, it may be possible to improve fuel efficiency by decreasing weight of the cover and reduce the cost to manufacture the cover.

While the present disclosure has been described with respect to the specific embodiments, it will be apparent to those skilled in the art that various changes and modifications may be made without departing from the spirit and scope of the invention as defined in the following claims.

What is claimed is:

1. A connector cover in an eco-friendly vehicle which covers an outside of a connector for an electronic part mounted to the eco-friendly vehicle, wherein the cover covers the outside of the connector, a width thereof is adjusted, grasps both sides of the connector, is coupled to the outside of the connector as the width of the cover becomes narrower, and the width remains narrowed, wherein the cover comprises:

a main body fastened to one side of the connector;

a pair of coupling portions which are slidably installed to the main body, pressed against the both sides of the connector while being inserted into the main body, and slide in opposite directions to each other; and a tightening means which maintains a state in which the coupling portions grasp the both sides of the connector.

2. The connector cover of claim 1, wherein the coupling portions are disposed on a same line as each other and slide in the opposite directions.

3. The connector cover of claim 1, wherein the tightening means comprises:

a fixing gear installed on a lower surface of the cover;

a tightening wheel which is rotatably installed to the cover and has an internal gear engaging with the fixing gear; and a wire which connects the tightening wheel to the coupling portions.

4. The connector cover of claim 3, wherein teeth of the fixing gear and the internal gear are formed such that the tightening wheel is rotatable only in a direction in which the wire is wound around the tightening wheel.

5. The connector cover of claim 4, wherein:

the teeth of the fixing gear and the internal gear form an inclined surface at a portion which abuts each other in a direction in which the wire is wound around the tightening wheel; and the teeth of the fixing gear and the internal gear form a vertical surface at a portion which abuts each other in the other direction in which the wire is wound around the tightening wheel.

6. The connector cover of claim 1, wherein the coupling portions are bent to be coupled to the connector.

7. The connector cover of claim 1, wherein the main body is formed with a fastening hole through which a fastening bolt for fastening the main body to the connector passes.

8. The connector cover of claim 1, wherein a back side of the main body is formed with a guide which supports the both sides of each of the coupling portions to guide sliding of the coupling portions.

9. The connector cover of claim 1, wherein a back side of the main body is formed with a guide which surrounds the outside of each of the coupling portions to guide sliding of the coupling portions.

10. A method of fastening a connector cover in an eco-friendly vehicle, which comprises a pair of coupling portions installed to a main body so as to be slidable in opposite directions to each other and grasps sides of a connector for an electronic part in the eco-friendly vehicle, to the connector, the method comprising steps of:

adjusting a width between the pair of coupling portions by sliding the coupling portions such that the width thereof is larger than a width of the connector;

mounting the cover to the outside of the connector;

grasping the sides of the connector by ends of the coupling portions such that the coupling portions support the sides of the connector and maintain a grasped state using a tightening means installed to the cover; and fastening the main body to the connector by a fastening bolt which passes through the main body and is fastened to the connector.

* * * * *